US006254331B1

(12) United States Patent
Pisco et al.

(10) Patent No.: US 6,254,331 B1
(45) **Date of Patent: *Jul. 3, 2001**

(54) COUPLER FOR CONNECTING AN ATTACHMENT TO THE FREE END OF A BOOM

(75) Inventors: Walter J. Pisco, Woodinville; Michael D. Hart, Seattle, both of WA (US)

(73) Assignee: Pacific Services & Mfg., Woodinville, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,569

(22) Filed: Feb. 4, 1999

(51) Int. Cl.[7] ..... B66C 23/00
(52) U.S. Cl. ..... 414/723; 37/468
(58) Field of Search ..... 414/723; 37/468, 37/906

(56) References Cited

U.S. PATENT DOCUMENTS 2,963,183 * 12/1960 Przybylski ..... 414/723
4,480,955 * 11/1984 Andrews et al. ..... 414/723
5,010,962 * 4/1991 Bloom, Jr. ..... 414/723 X
5,147,173 * 9/1992 Fauber et al. ..... 414/723
5,332,353 * 7/1994 Arnold ..... 414/723
5,494,396 * 2/1996 Geier et al. ..... 414/723
5,584,644 * 12/1996 Oroegemuelles ..... 414/723
5,890,871 * 4/1999 Woerman ..... 414/723

* cited by examiner

*Primary Examiner*—Donald W. Underwood
(74) *Attorney, Agent, or Firm*—Delbert J. Barnard

(57) ABSTRACT

A rear end hook structure (44, 46) on a coupler (10) presents rearwardly directed hook throats (48, 50) which engage a rear coupler pin (96) on a attachment (94). An initially downwardly angled front end hook structure (52), presenting a forwardly directed hook throat (54), is movable by movement of a coupler (10) to move a forward coupler pin (96) on the attachment (94) into the hook throat (54). Then, the coupler (10) is moved further to swing the front end hook structure (52) upwardly into an up position in which it is against a bottom plate (40) on the coupler (10). Movement of the front end coupler structure (52) into its up position moves a hook tine (60) upwardly through a slot opening (62) in the bottom plate (40) of the coupler (10). The hook tines (60) moves upwardly until its rearwardly directed hook throat (78) is positioned to receive a lock member (66, 116, 180). Then, a spring (84, 190, 192) moves the lock member (66, 116, 180) into the hook throat (54).

19 Claims, 9 Drawing Sheets

FIG. 7
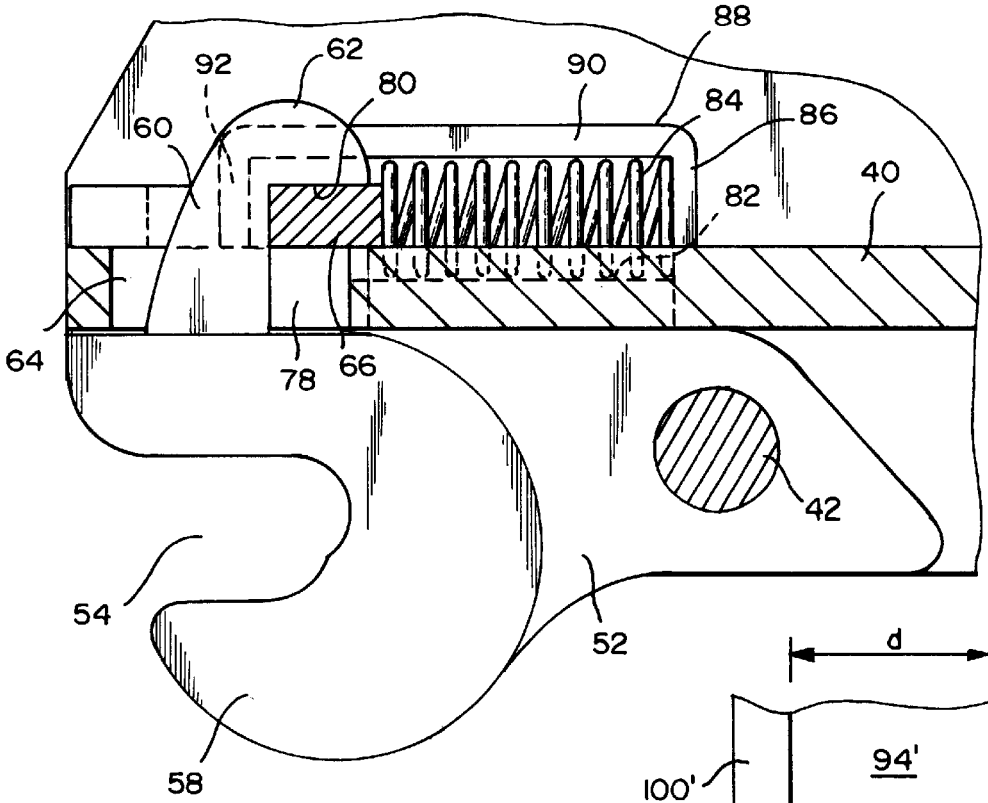
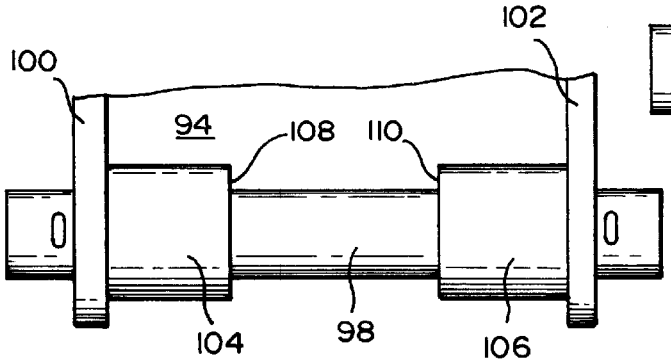
FIG. 8A
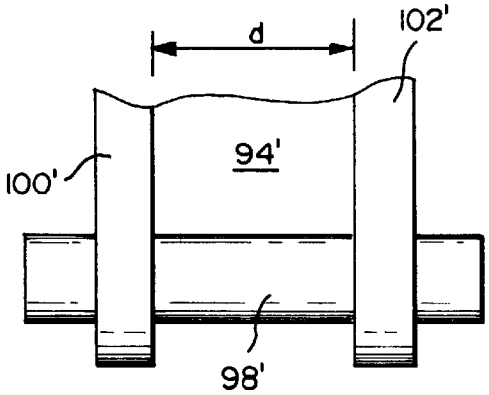
FIG. 9
FIG. 8
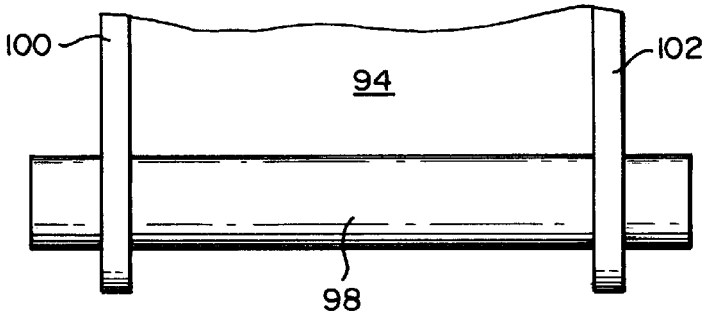

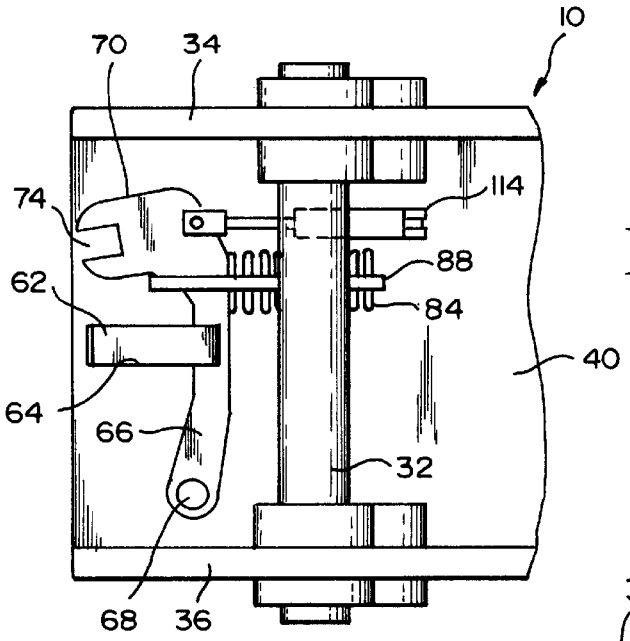
FIG. 10
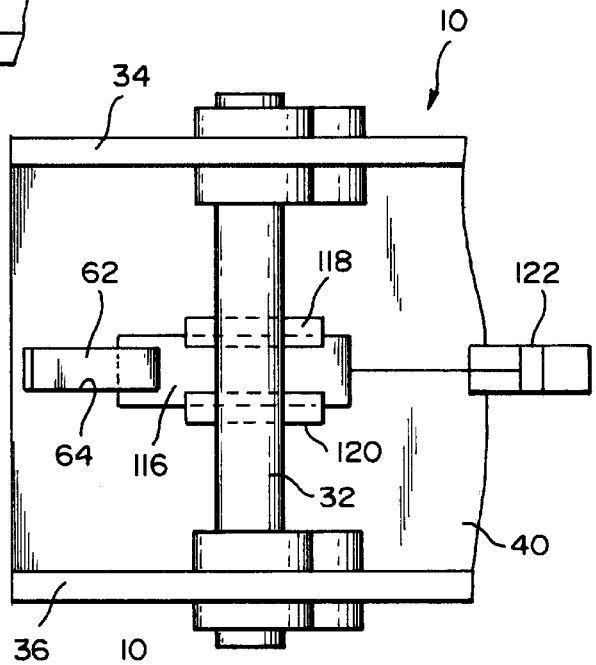
FIG. 11
FIG. 12
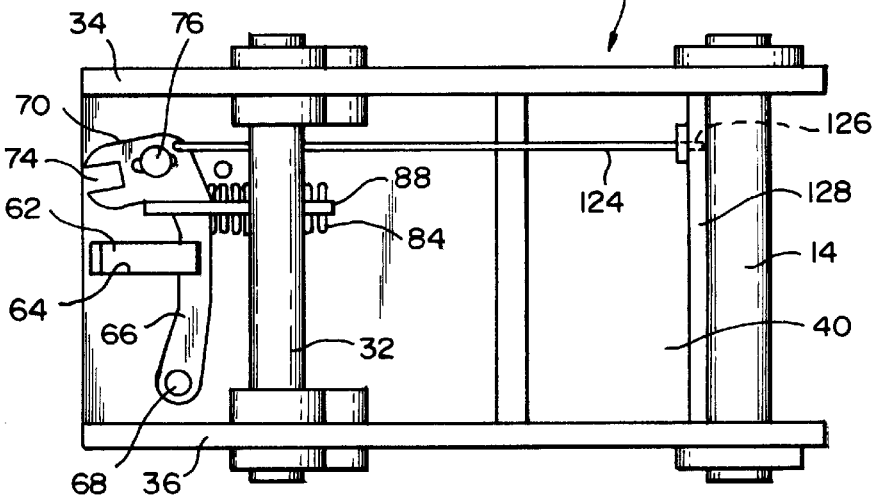

COUPLER FOR CONNECTING AN ATTACHMENT TO THE FREE END OF A BOOM

TECHNICAL FIELD

This invention relates to a coupler for connecting a bucket, a breaker, a compactor or some other attachment to the free end of a boom or working arm or the like on a piece of work equipment, such as a backhoe, etc.

BACKGROUND OF THE INVENTION

U.S. Pat. No. 5,584,644, granted Dec. 17, 1996, to David Droegemueller, and entitled, "Coupling System", discloses a prior art coupler for connecting an attachment to the free end of a boom or working arm on a backhoe, etc. This patent also describes the prior art that preceded the invention disclosed by the patent. The invention disclosed by the patent require two lock pins 30 and the assertion of these lock pins 30 through aligned openings in members 21, 28, 32 on a first side of the attachment and in members 22, 28, 32 on the opposite side of the attachment. A first hook structure 24 is positioned to engage a first coupler pin 17 on the attachment. A second hook structure 26 is positioned to receive a second coupler pin 18 on the attachment 12. Then, the hook structure 26 is swung upwardly to move the members 28 upwardly through openings 11A, and place the pin receiving openings into axial alignment on both sides of the attachment. Then, the lock pins 30 are inserted through the aligned openings to lock the hook structure 26 to the sidewalls 21, 22 of the coupler 10.

There is a need for an easier-to-use coupler that allows a quick and automatic coupling of the attachment to the coupler without anyone having to insert lock pins through aligned openings. A principal object of the invention is to provide such an improved coupler.

The aforementioned U.S. Pat. No. 5,584,644 and the prior art described in it should be carefully studied for the purpose of putting the present invention into proper prospective with respect to the prior art.

DISCLOSURE OF THE INVENTION

According to a first aspect of the invention, a coupler is connectable to the free end of a boom and to a boom attachment, for connecting the boom attachment to the free end of the boom, by use of a pair of parallel, spaced apart coupler pins on the attachment. In some embodiments, the coupler comprises a coupler frame including a forward end, a rearward end and a bottom plate. The bottom plate has a forward end slot extending through it. A rear end hook structure is connected to the frame below the bottom plate. The rear end hook structure includes a rearwardly opening rear hook throat.

A front end hook structure includes a first hook throat and an opposite pivot end. The pivot end is pivotally connected to the frame below the bottom plate, for pivotal movement of the front end hook structure between an up position in which the front end hook throat opens forwardly and a down position in which the front end hook structure and the front hook throat are angled downwardly from the bottom plate.

A top hook (or hooks) is provided on the front hook structure. Each top hook extends upwardly from the front end hook structure through a forward end slot in the bottom plate when the front end hook structure is in its up position. Each top hook includes a top hook tine that is spaced above the bottom plate when the front hook structure is in its up position, to provide a top hook throat between the top hook tine and the bottom plate. A lock member is provided above the bottom plate. The lock member is movable between a first position in which it is spaced rearwardly from the top hook throat and a second position in which a portion of the lock member is located within the top hook throat, between the top hook tine and the bottom plate, for locking the front hook structure in its up position.

The boom and the coupler can be moved together to position the rear coupler pin attachment within the rear hook throat, and further to position the front coupler pin of the attachment within the front hook throat when the front hook structure is in its down position. This construction allows the boom and coupler to be moved relative to the attachment to swing the front hook structure up into its up position and move the top hook into and through the forward end slot, so as to position the top hook tine and the top hook throat above the bottom plate. This allows the lock member to be moved from its first position to its second position to place a portion of the lock member in the top hook throat. So positioned, the lock member functions to block downward movement of the front hook structure from its up position to its down position.

According to another aspect of the invention, the rear hook structure comprises a pair of laterally spaced apart hook members, each including a portion of the rear hook throat.

According to yet another aspect of the invention, the front end hook structure comprises a pair of laterally spaced apart hook members, each including a portion of the front hook throat.

The lock member may be a swing arm having a first end portion that is pivotally attached the coupler frame and a second end portion which includes the portion of the lock member that is within the top hook throat when the lock member is in its second position. A spring may be provided and positioned to bias the swing arm lock member into its second position.

According to another aspect of the invention, the lock member is a member that reciprocates into and out from the top hook throat. This member may include a spring for biasing it into a position within the hook throat.

According to still another aspect of the invention, the lock member, whether it be a swing member or a front-to-rear reciprocating member, may be moved by a linear fluid motor or actuator. Such actuator may be used by itself or with a biasing spring or springs.

According to a further aspect of the invention, the front hook structure may include two top hook tines and the bottom plate may include two spaced apart slots, each for receiving a different one of the tines.

According to a still further aspect of the invention, the coupler may be provided with a gauge rod that is connected to the lock member and extends rearwardly of the rearward end of the coupler frame. The rear end portion of the gauge member and a rear portion of the coupler frame combine to indicate to an operator positioned behind the boom when the lock member is in its second position.

These and other advantages, objects and features will become apparent from the following best mode description, the accompanying drawings, and the claims, all of which are incorporated herein as part of the disclosure of the invention.

BRIEF DESCRIPTION OF THE DRAWINGS

Like reference numerals are used to designate like parts throughout the several views of the drawing, wherein:

FIG. 7 is a fragmentary side elevational view of the front end structure locked in its up position by a lock member positioned within the top hook throat of the top hook tine, such view being taken substantially along line 7—7 of FIG. 4;

FIG. 8 is a fragmentary front elevational view of a coupler pin on a bucket.

FIG. 8A is a view like FIG. 8 but of a coupler pinto onto which a pair of spacers have been added, for the purpose of providing a shorter length coupler section of the coupler pin;

FIG. 9 is a view like FIG. 8, but showing a shorter coupler pin;

FIG. 10 is a view like FIG. 4, but smaller in scale, further including a linear fluid motor that is provided for extending and retracting the lock member;

FIG. 11 is a view like FIG. 10 but showing a front-to-rear sliding lock member in place of a swinging lock member;

FIG. 12 is a view like FIG. 10, but showing the addition of a position indicating rod attached to the lock member and extending rearwardly from the lock member to an through an opening in a rear wall portion of the coupler;

BEST MODE FOR CARRYING OUT THE INVENTION

Figure 1:
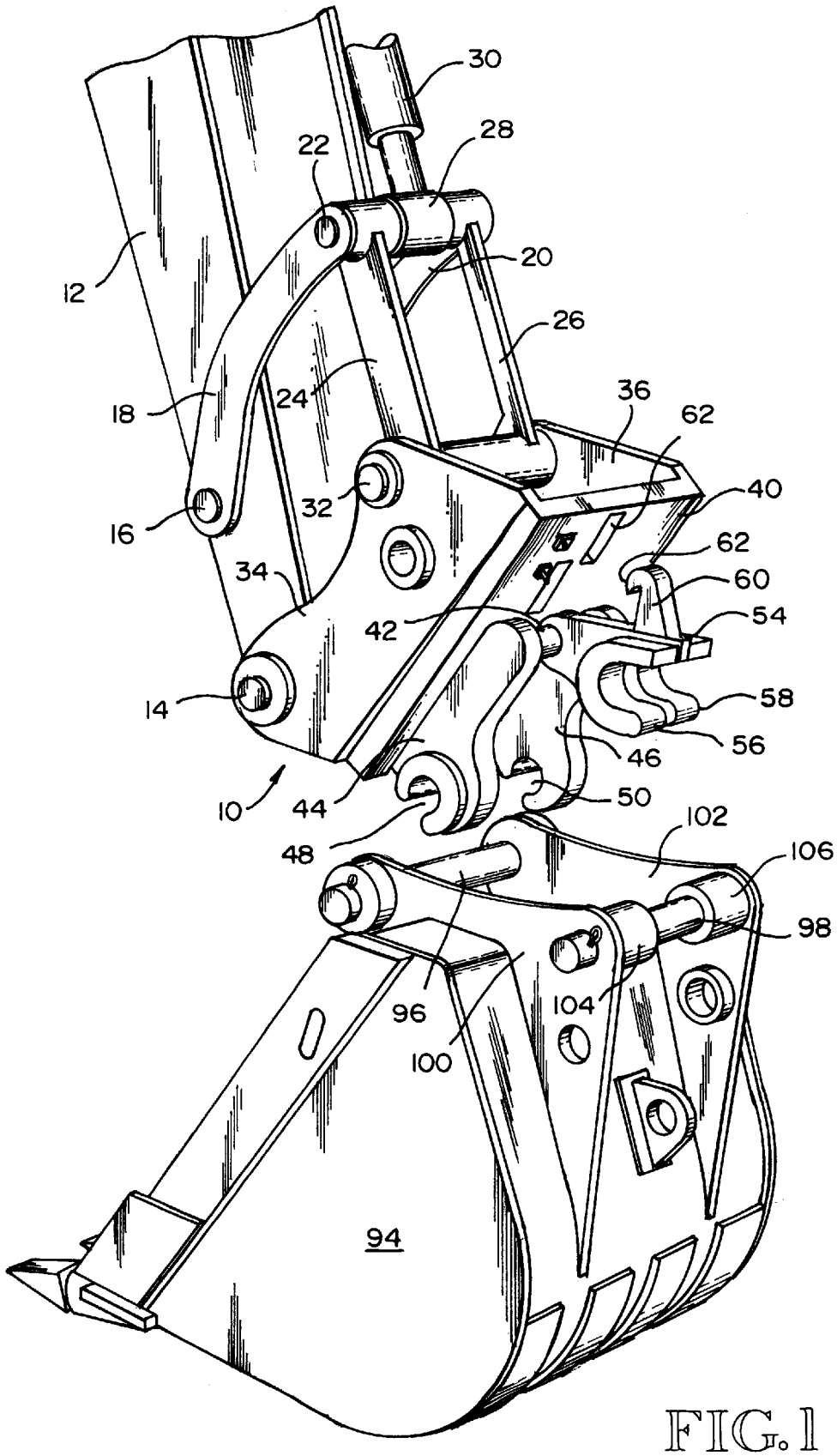
FIG. 1 is a pictorial view of a fragmentary end portion of a boom, such view showing a coupler on the end of the boom and showing a bucket detached from and space below the coupler, such view being taken towards the front and one side of the boom end portion, the coupler and the bucket.

FIG. 1 shows a coupler 10 connected to the free end of a boom 12 by structure including a first transverse pivot pin 14. A second transverse pivot pin 16, spaced upwardly on the boom 12 from pin 14, pivotally connects first ends of a pair of links 18, 20 to the boom 12. The opposite ends of the links 18, 20 are pivotally connected by a third transverse pivot pin 22 to upper ends of a pair of links 24, 26 and to the lower end 28 of a linear hydraulic motor or "actuator" 30. A fourth transverse pivot pin 32 pivotally connects the lower ends of the links 24, 26 to the coupler 10. The portion of coupler 10 extending between pivot pins 14, 32, the portion of boom 12 extending between pivot pins 14, 16, the links 18, 20 and the links 24, 26 together form a four-bar linkage. Linear motor 30 acts on the linkage to swing the coupler 10 in position about the longitudinal axis of pivot pin 14.

In preferred form, coupler 10 comprises a frame composed of a pair of opposite side plates 34, 36 and a bottom plate 40. Side plates 34, 36 are substantially perpendicular to bottom plate 40. The pivot pins 14, 32 extend transversely of the coupler 10 and at their ends extend through openings in the side plates 34, 36. Preferably, the side plates 34, 36 are provided with bushings or bearings surrounding each opening. The end portions of the pivot pins 14, 32 extend through the bushings or bearings.

FIG. 1 presents a good view of the bottom of the coupler 10. It shows that below the bottom plate 40 there is a rear end hook structure that is connected to the plate 40. Rear end hook structure includes a rearwardly opening rear hook throat. Below bottom plate 40, there is also a front end hook structure having a front hook throat end and a opposite pivot end. The pivot end is pivotally connected by a pivot pin 42 to the rear end hook structure. The front end hook structure is pivotally connected for movement between a down position in which the front end hook structure and the front hook throat are angled downwardly from the bottom plate 40, and an up position in which the front end hook throat opens forwardly and the front end hook structure is up substantially against the bottom plate 40.

In preferred form, the rear end hook structure comprises a pair of side hooks 44, 46, each having a generally rearwardly directed hook throat 48, 50. The front hook structure comprises a single central hook member 52 that is connected at its rear end to the pin 42, or is connected at its rear end to pivot around the pivot pin 42. Pivot pin 42 may be either a dead axle or a live axle. If it is a dead axle, the hook member 52 rotates relative to it. If it is a live axle, it and the hook member 52 rotate together, relative to the side hook parts 44, 46 of the rear hook member.

Front hook member 52 includes a front end throat 54. U-shaped side members 56, 58 may be secured to the opposite sides of the front hook member 52, so as to widen the hook throat 54. Front hook member 52 includes an upwardly projecting hook tine 60. Hook tine 60 includes an end hook 62. Tine 60 is movable upwardly into and through a slot 64 formed in the bottom of bottom plate 40. As best shown by FIG. 7, to be described later, when the front hook structure is in its up position, the end hook 62 is spaced above the floor of the bottom plate 40.

Figure 4:
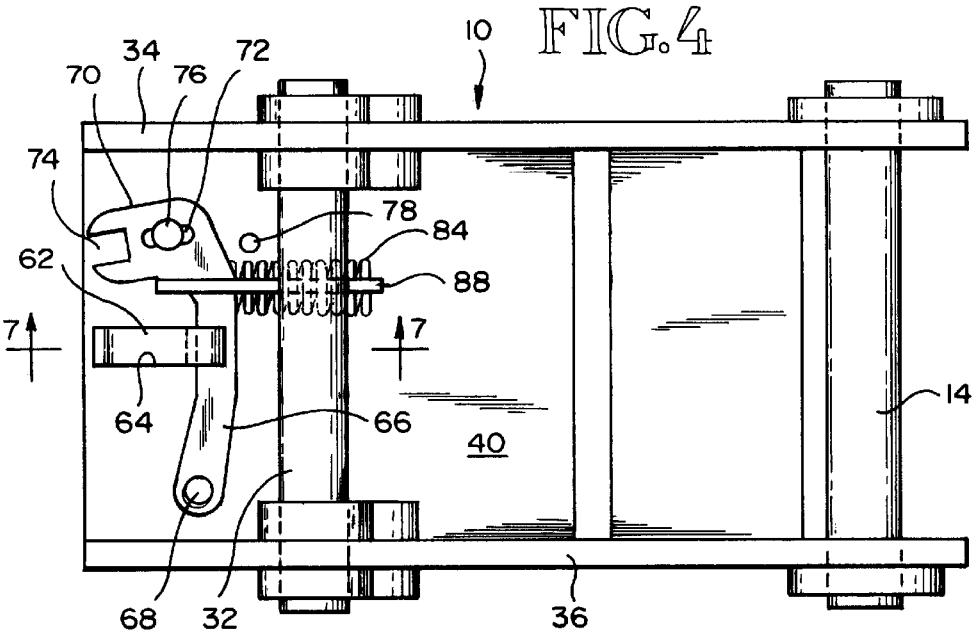
FIG. 4 is a top plan view of the coupler in the condition shown by FIG. 3.

Referring to FIG. 4, a lock arm 66 is positioned on bottom plate 40 closely adjacent the slot opening 64. One end of lock arm 66 is pivotally attached to the bottom plate 40 by means of a pivot pin 68. The opposite end of lock arm 66 includes an enlarged end portion 70 having a pin receiving opening 72 and a forwardly directed recess 74. A lock pin 76 is insertable through the opening 72 into one or the other of a pair of openings in the bottom plate 40. In FIG. 4, the pin 76 is positioned within the forward such opening in plate 40. The rearward opening is designated 78. When the pin 76 is in the forward opening, as pictured, an intermediate portion of lock arm 66 is positioned in the throat 78 of hook tine 60, between the upper surface of bottom plate 40 and a lower hook surface 80 of tine 60, as shown in FIG. 7. When in this position, the hook arm 66 locks the front end hook structure in its up position. A spring well 82 is formed in bottom plate 40, rearwardly of lock arm 66. A compression spring 84 is positioned within the spring well 82. The rear end of the spring 84 abuts against a vertical part 86 of a spring cage 88. A horizontal part of the spring cage 88, designated 90, extends forwardly from part 86 over the spring 84, to a front end vertical part 92. The spring cage 88 and the well 82 function to hold the spring 84 in position on the bottom plate 40. The spring 84 is movable forwardly and rearwardly but is otherwise captured and held against movement. In FIG. 7, the spring 84 is compressed and is exerting a force on the lock arm 66, towards maintaining it within the hook throat 78. When the lock arm 66 is within the hook throat 78, the front hook structure is locked into its up position against the bottom of bottom plate 40. When pin 76 is placed through the opening 72 in the lock arm 66 and the complementary opening (not shown) in bottom plate 40, the lock arm 66 is secure in its position within the hook throat 78. As long as lock pin 76 is in place, the front hook structure is prevented from moving downwardly from its up position to its down position.

When it is desired to unlock the front hook structure from the coupler frame, the lock pin 76 is removed. Then, a tool (not shown) is inserted into socket 74 and used to push rearwardly on the end portion 70 of lock arm 66, to move the central portion of the lock arm 66 out from the hook throat 78. During this movement, the compression spring 84 is compressed. The swing arm 66 is moved rearwardly until the opening 72 comes into alignment with opening 78. Then, the lock pin 76 can be inserted through opening 72 and 78, to lock the lock arm 66 in a rearward position. When lock arm 66 is in its rearward position, it is moved entirely out from the hook throat 78. As a result, the front end hook structure is free to rotate downwardly into its down position.

The coupler 10 cooperates with structure on an attachment for coupling the attachment to the arm 12. By way of typical and therefore nonlimitive example, the attachment 94 may be a bucket. In any event, the attachment 94 includes a pair of coupler pins 96, 98. The coupler pins 96, 98 may be attached at their ends to a pair of laterally spaced apart side plates 100, 102 that are connected to and project upwardly from the attachment 94. Coupler pin 96 is receivable within the hook throat 48, 50 of the rear end hook structure. Coupler pin 98 is receivable within the hook throat 54 of the front end hook structure 52. In FIGS. 1 and 8A, the coupler pin 98 is provided with enlarged diameter end portions 104, 106. As will be described below, the enlarged end portions 104, 106 may constitute a pair of sleeves 104, 106 that have been added to a constant diameter coupler pin 98. The distance between the inner surfaces 108, 110 of the end portions 104, 106 is sized to rather snugly receive the width dimension of the forward end hook structure 52.

Figure 2:
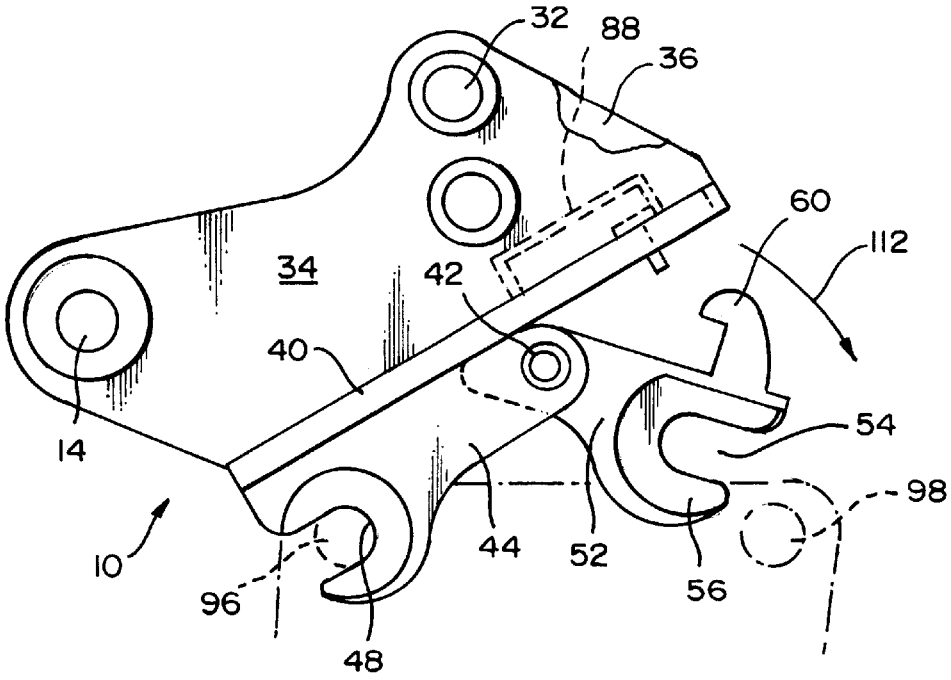
FIG. 2 is a side elevational view of the coupler, with the front end hook structure in its down position, such view showing the rear end hook structure engaging a first coupler pin on the attachment and showing the front end hook structure being rotated towards a position of engagement with a second coupler pin on the attachment.
Figure 3:
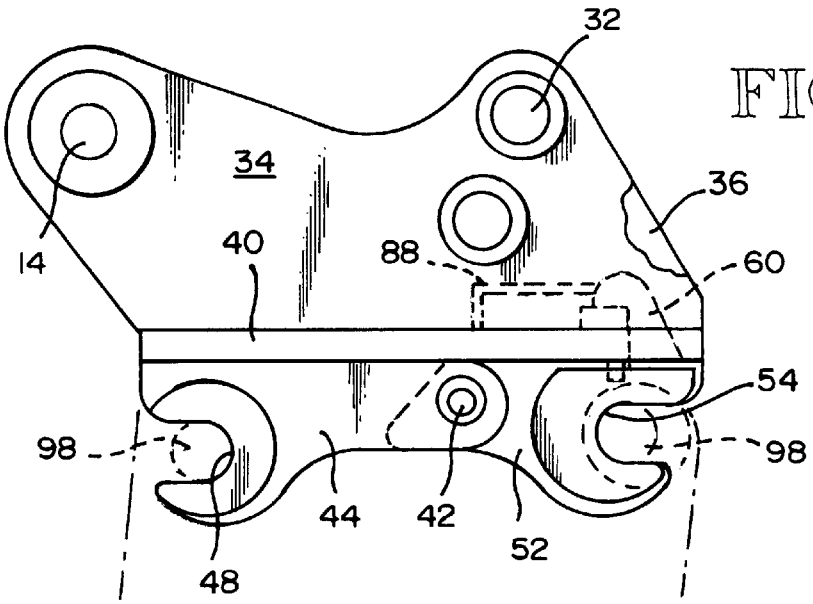
FIG. 3 is a view like FIG. 2, but showing the front end hook structure engaging the second coupler pin and showing the front end hook structure in its up position, and showing the lock member on the bottom plate positioned within the hook throat of the front end hook structure.

FIG. 2 shows the coupler 10 being connected to the attachment 94. The boom 12 or other structure to which the coupler 10 is connected is manipulated to move the rear end hook throat 48, 50 about the coupler pin 96. This is done with the front end hook structure 52 in its down position, as shown in FIG. 2. After the coupler pin 96 is within the rear end hook throat 48, 50, the boom or other structure 12 is moved to rotate the coupler 10 downwardly, in the direction of arrow 112. This rotation of the coupler 10 moves the front end hook throat 54 into a position to receive coupler pin 98. Engagement is made between the coupler pin 98 and the hook throat 54 while the front end hook structure 52 is still in its down position and the coupler 10 is being rotated forwardly. Following initial engagement of the coupler pin 98 and the front end hook throat 54, further downward rotation of the coupler 10 both moves the coupler pin 98 relatively in the forward end hook throat 54 and will rotate the front end hook structure 52 upwardly to place it in its up position. This is shown in FIG. 3. As the front end hook structure 52 moves upwardly, the hook tine 60 moves upwardly into and through slot opening 64. At that time, the lock arm 66 is either locked by the lock pin 76 into its rear position, out of the path of hook tine 60. Or, the lock pin 76 is removed and the lock arm 66 is biased forwardly by the compression spring 84. In the latter case, the rounded upper end of hook tine 60 contacts the lock arm 66 as tine 60 moves upwardly and it cams the lock arm 66 rearwardly, against the force of compression spring 84. That is, the rounded cam surface on top of hook tine 60 contacts a central portion of lock arm 66 and exerts a rearward force on lock arm 66 as the hook tine 60 continues to move upwardly through the slot opening 64. This force swings the lock arm 66 rearwardly against the force of compression spring 84. Then, once the front end hook structure 52 is in its up position, and the hook throat 78 is in the position shown by FIG. 7, the compression spring 84 acts on the lock arm 66 to swing it forwardly into the previously described position that is shown in FIG. 7 where lock arm 66 serves to lock the front end hook structure 52 in its up position. At this time, the coupler pin 96 is captured within the rear end hook throat 48, 50 and the coupler pin 98 is captured within the front end hook throat 54. As a result, the attachment 98 cannot shift in position either forwardly or rearwardly. Contact between coupler pin 98 and the forward end hook throat 54 prevents a rearward movement of the attachment 94 relative to the coupler pin. Engagement of the coupler pin 96 with the rear end hook throat 48, 50 prevents a forward movement of the attachment 94 relative to the coupler 10. The side plates 100, 102 and the end surfaces 108, 110 prevent sideways movement of the attachment 94 relative to the coupler 10. The lower portions of the rear end and front end hook structures prevent the attachment 94 from dropping downwardly away from the coupler 10.

FIG. 10 shows a linear fluid motor 114 interconnected between lock arm 66 and bottom plate 40. As illustrated, one end of the motor 114 is attached to the enlarged end portion 70 of the lock arm 66. The opposite end is attached to the coupler frame, e.g. to the bottom plate 40. Extension of the motor 114 swings the lock arm 66 forwardly. Retraction of the motor 114 swings the lock arm 66 rearwardly. In this embodiment, there is no need to use the lock pin 76. The lock arm 66 can be held in position by the motor 114. In FIG. 10, the motor 114 is shown to be used in conjunction with the compression spring 84. At times it may be desirable to omit the compression spring 84 and use the linear motor 114 by itself.

When compression spring 84 is used, fluid pressure can be removed from motor 114, to make it passive. Then, as the coupler 10 is being moved relative to the attachment 94, to couple the two together, movement of hook tine 62 against lock arm 66 will exert a force on lock arm 66, swinging it rearwardly, against the force of compression spring 84, until the hook throat 78 is exposed above the bottom plate 40, in a position to receive the lock arm 66, as shown by FIG. 7. Then, when it is desirable to decouple, fluid pressure is introduced into motor 114 to cause it to retract and pull the lock arm 66 rearwardly until it is free of the hook throat 78 and the tine 62 is free to move out of the slot opening 64 and away from the coupler 10. When the compression spring 84 is eliminated, the fluid motor 114 can be used for swinging the lock arm 66 in both directions. For example, it can be retracted for pulling the swing arm 66 rearwardly to allow the hook tine 62 to move upwardly through slot opening 64 without any contact with lock arm 66. Then, when the front end hook structure is in its up position, the linear motor 114 can be extended for the purpose of moving the lock arm 66 into the hook throat 78. Then, when it is desired to decouple, the linear motor 114 can be used for pulling the lock arm 66 rearwardly and out of engagement with the hook throat 78.

FIG. 11 shows another embodiment of the invention in which the swinging lock arm 66 is replaced by a front-to-rear sliding lock plate 116. Lock plate 116 is connected to the bottom plate 40 by guiding and retaining members 118, 120. Members 118, 120 have vertical outer legs that are attached to the bottom plate 40 and horizontal top legs that extend from the outer legs over side portions of the lock plate 116. Members 118, 120 form a slideway that holds the lock plate 116 down against the bottom plate 50, but allows it to move back and forth endwise. Lock plate 116 is connected to a linear fluid motor 122 which is used for moving lock plate 116 forwardly and rearwardly. It is moved forwardly to place it into a position within the hook throat 78, for locking the hook tine 62 relative to the coupler 10. It is retracted for the purpose of pulling the lock plate 116 out from the hook throat 78, so that the hook tine 62 and the front end structure can swing down into their down positions.

FIG. 12 shows the embodiment of FIG. 4, but provided with a position indicator for the lock arm 66. It is simple and consists of a rod 124 that is pivotally attached at its forward end to the free end portion 70 of lock arm 66. Rod 124 extends rearwardly from lock arm 66 to and through an opening 126 in a rear wall 128 on the coupler 10. When the lock arm 66 is moved forwardly into a lock position, the rear end of the rod 124 is substantially flush with the rear surface of wall 128 or is forwardly of the rear surface. When the lock arm 66 is swung backwards, to move it out of engagement with the hook throat 78, the rear end portion of the rod 124 moves rearwardly through the opening 126. A small end portion of the rod 124 projects rearwardly from the wall 128. An operator sitting the backhoe or other machine behind the attachment can see the position of the rear end of rod 124 and know whether the lock arm 66 is in a forward "locked" position or in a rearward "unlocked" position. The indicator rod 124 can also be used with the sliding lock plate 116.

In preferred form, the coupler 10 is adapted to be used with a number of different types of attachments, including attachments and makes having coupler pins of different diameter and spacing. The present invention is not limited to use with any particular attachment or any particular boom structure, or the like. A bucket attachment 94 is illustrated in FIG. 1. U.S. Pat. No. 4,133,394, granted Jan. 9, 1979, to Maurice Wohlwend, presents a typical example of a hydraulic breaker that is adapted to be supported at the end of a boom or similar structure. U.S. Pat. No. 3,917,426, granted Nov. 4, 1975, to Donald M. Wohlwend and Maurice Wohlwend, presents a typical example of a compactor that is adapted to be mounted on the end of a boom or similar structure.

FIG. 8 shows a front end coupler pin 98 of a particular length. FIG. 8A shows the same attachment 94 and coupler pin 98 but with sleeves 104, 106 added to the coupler pin 98. The sleeves 104, 106 are placed on the coupler pin 98, between the two side plates 100, 102 and are then moved outwardly in the contact with the side plates 100, 102. This provides a spacing between the end surfaces 108, 110 of the sleeves 104, 106 that is identical to spacing d between the side plates 100', 102' of a different manufacturer's attachment. According to an aspect of the invention, the front end hook structure is made of a width to fit between the side plates 100', 102'. It can then be used with the attachment 94 having a longer coupler pin 98. The addition of the sleeves 104, 106 functions to reduce the effective length of the coupler pin 98 where it engages the front end hook structure. A similar modification is not needed at the rear end coupler pin 96 because in the two makes of the attachment the length of the coupler pin 96 is the same.

Figure 16:
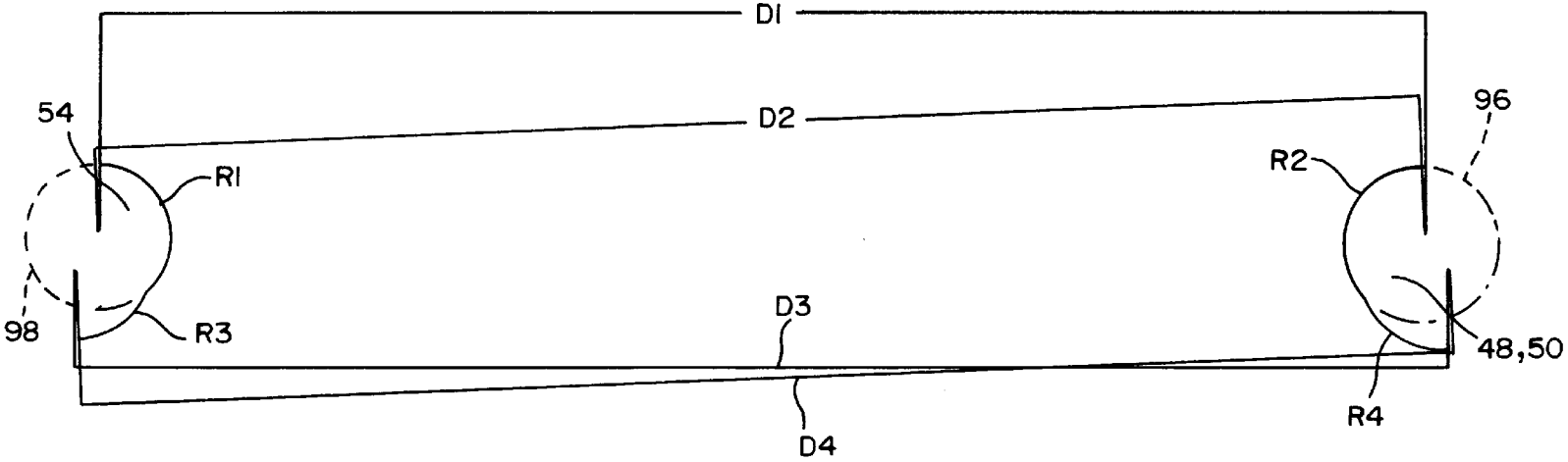
FIG. 16 is a diagram of a preferred configuration of the front and rear hook structure, showing coupler pins of a first diameter and spacing within the hook throats.
Figure 17:
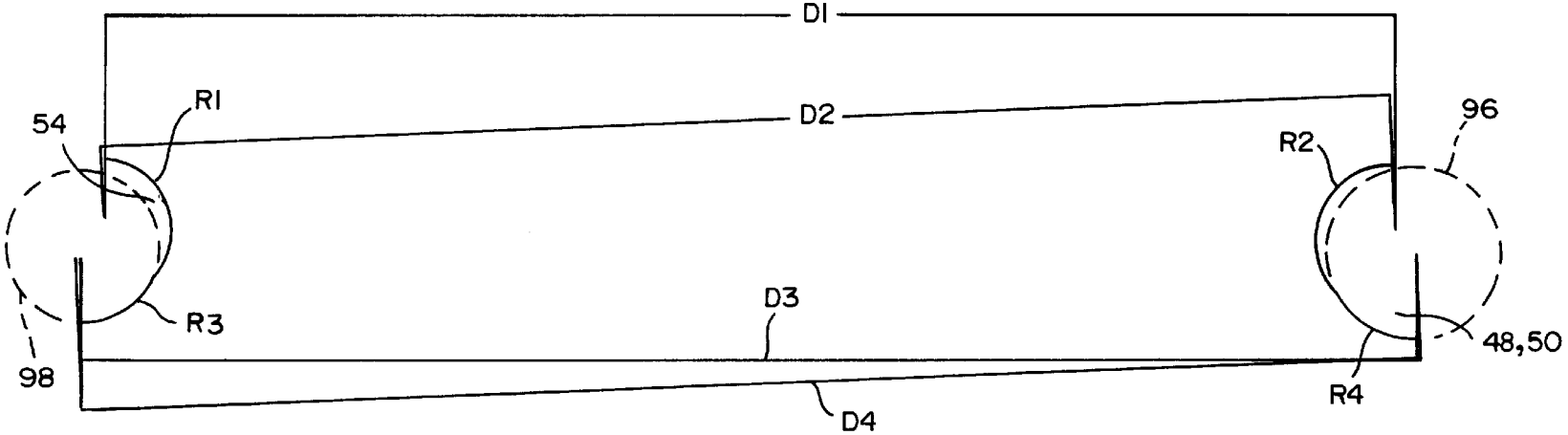
FIG. 17 is a view like FIG. 16 but showing two coupler pins of a different diameter and spacing within the same hook throats.

One make has coupler pins that are slightly smaller in diameter than the other make and such coupler pins are spaced apart a greater distance than the coupler pins of the other make. To accommodate for this difference, the front and rear end hook structures are provided with hook throats that are constructed to accommodate both diameters and both spacings. This is shown in FIGS. 5, 6, 16 and 17. Referring to FIGS. 16 and 17, the hook throats 48, 50 and 54 each has a small diameter region and a large diameter region. By way of typical and therefore non limitive example, the small diameter region of hook throat 54 shows a radius R1. This radius may be 0.756 inches. The larger diameter region is designated R3. The radius at R3 may be 0.831 inches. The small diameter radius for hook throats 48, 50 is designated R2. This radius may be 0.875 inches. The large diameter region of hook throats 48, 50 are identified by radius R4. This radius may be 1.000 inches. The centers of the small diameter regions, measured between one set of radius lines is designated D1. Measured between a second set of radius lines it is designated D2. By way of typical and therefore non limitive example, dimension D1 may be 14.003 inches. Dimension D2 may be 13.984 inches. In similar fashion, the distance between the centers of the large diameter regions measure between a first set of radius lines is designated D3. Measure between a second set of radius lines is it designated D4. By way of typical and therefore non limitive example, dimension D3 may be 14.499 inches. Dimension D4 may be 14.484 inches.

Figure 5:
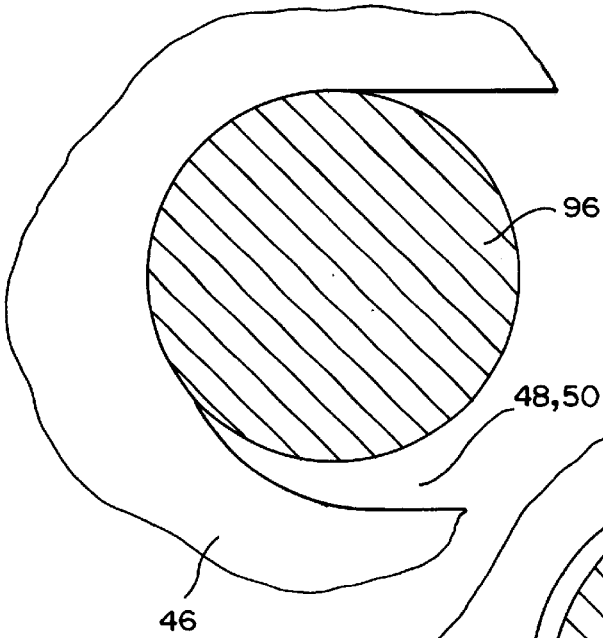
FIG. 5 is an enlarged scale side elevational view of fragmentary end portions of the front and rear end hook structures, engaging small diameter coupler pins.
Figure 6:
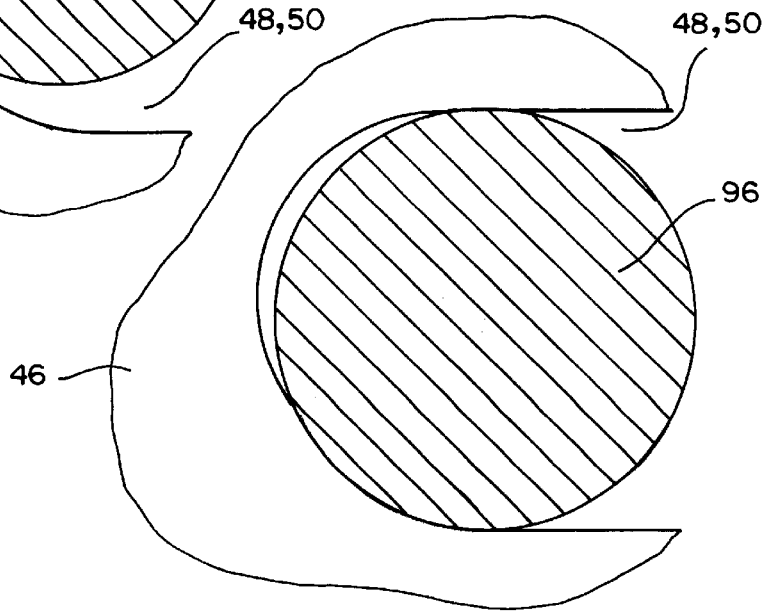
FIG. 6 is a view like FIG. 5 but showing the front and rear end hook structures engaging larger diameter coupler pins.

FIGS. 16 and 17 show small diameter coupler pins 96, 98 within the small diameter regions of the hook throats. FIG. 17 shows larger diameter coupler pins 96', 98' located within the large diameter regions of the hook throats. FIG. 5 shows small diameter coupler pin 96 within the small diameter regions of hook throats 48, 50. FIG. 6 shows a larger diameter coupler pin 96' within the larger diameter region of hook throats 48, 50. Of course, in other installations, the coupler pin diameters, the dimensions of the small diameter and large diameter regions of the hook throats, and the spacing of the coupler pins can vary and the substance of the invention can still be used.

Figure 13:
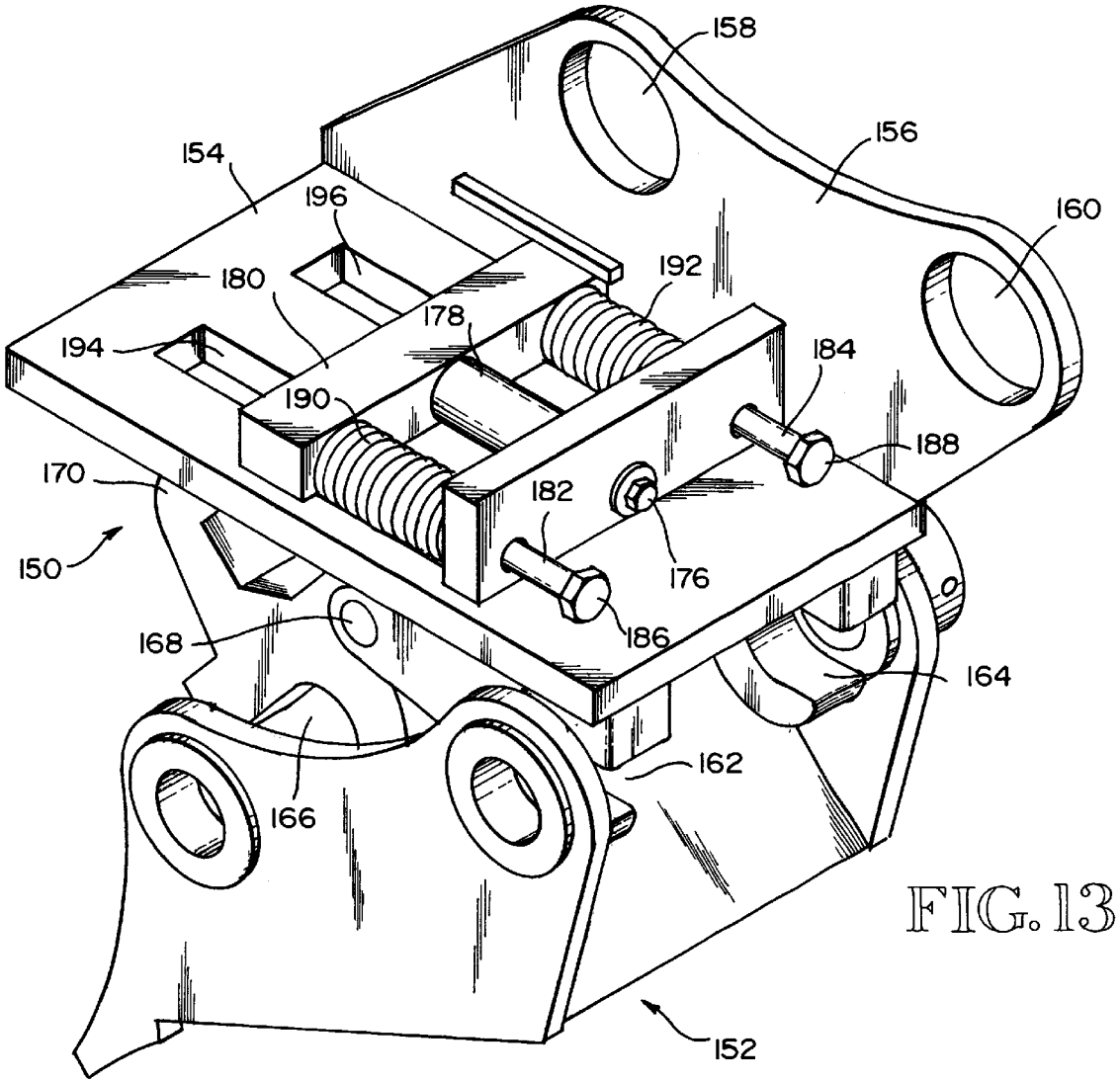
FIG. 13 is a pictorial view of an additional embodiment of the invention, with the foreground side plate omitted for clarity of the parts that are behind it, such view showing the front hook portion of the coupler in its down position, and showing a sliding lock bar in a retracted position, and held in that position by a linear fluid motor.
Figure 14:
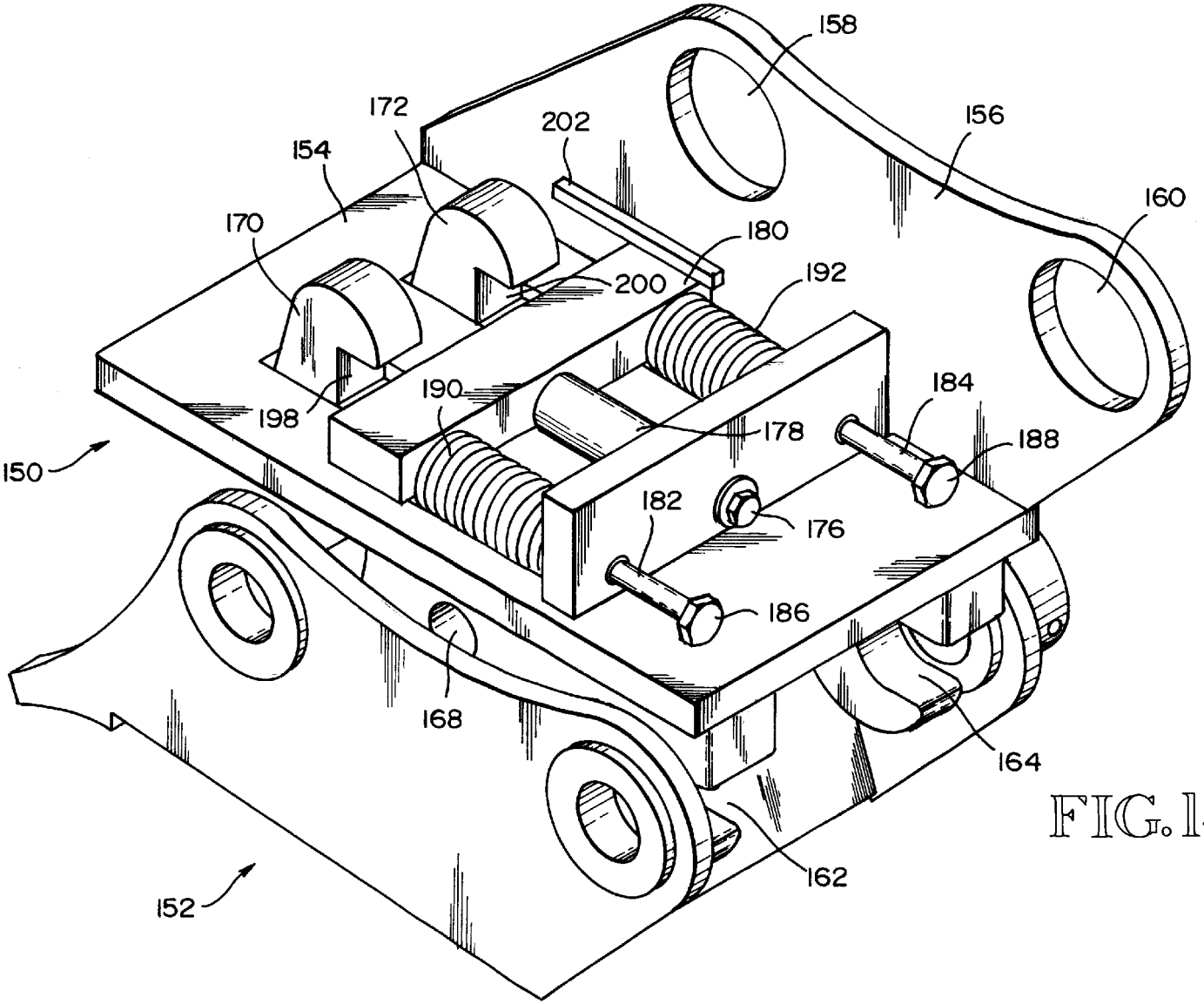
FIG. 14 is a view like FIG. 13, but showing the front end hook structure in its up position and a pair of tines moved upwardly through slots in the bottom plate.
Figure 15:
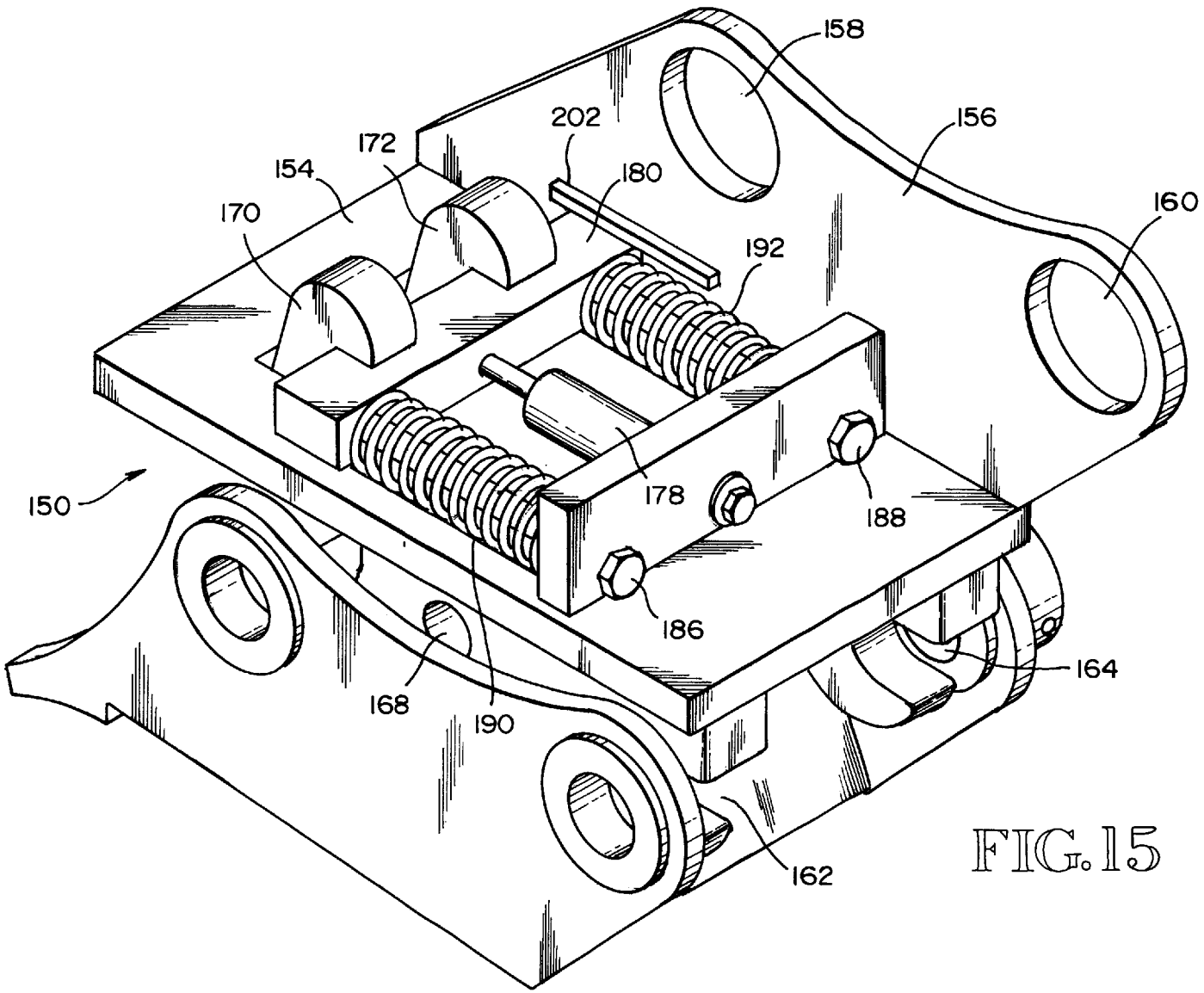
FIG. 15 is a view like FIG. 14, but showing the linear fluid member extended to move the lock member into the hook throats of the two hook tines.

FIGS. 13–15 show another embodiment of the invention. These figures show a fragmentary portion of a coupler 150 and fragmentary portion of an attachment 152. The coupler 150 is missing the foreground side plate. It includes a bottom plate 154 and a side plate 156. The missing side plate is essentially like side plate 156. The openings 158, 160 in side plate 156, and identical openings in the missing side plate, serve to receive the opposite end portions of the coupler pins 14, 32 used to secure the coupler 150 to the boom or other supporting structure. FIGS. 13–15 are taken from above and are looking toward the rear and one side of the coupler/attachment assembly 150, 152. The rear hook structure is shown in the foreground to include hook throats 162, 164. In FIGS. 13–15, the coupler pin 96 that is received within the hook throats 162, 164 has been omitted. In this embodiment, the front end hook structure includes a pair of hook members, each having a hook throat, one of which is designated 166 in FIG. 13. A similar hook throat is provided on the opposite side of the coupler 150. As in the first embodiment, the front end hook structure is pivotally attached to or by a pivot pin 168, for pivotal movement between a down position (FIG. 13) and an up position (FIGS. 14 and 15). Each hook member is provided with an upwardly extending hook tine. The hook tines are designated 170, 172 in FIGS. 14 and 15. FIG. 13 shows a portion of hook tine 170 above hook throat 166. The second hook tine 172 is above a second, like hook throat on the opposite side of the coupler 150. A first difference between coupler 150 and coupler 10 is that coupler 10 has a single front end hook whereas coupler 150 has two front end hooks that are spaced laterally apart like the rear end hooks. A second difference is that coupler 150 has a different lock structure than coupler 10.

Referring to FIGS. 13–15, a frame member 174 extends laterally of base plate 154 and is welded or otherwise secured to the base plate 154. A rear end portion 176 of a fluid motor 178 is connected to the frame member 174. The fluid motor 178 projects forwardly of the frame member 174 and at its opposite end is connected to a sliding lock block 180. The assembly includes a pair of guide bolts 182, 184. In preferred form, guide bolts 182, 184 extend through openings in frame member 174 and then extend forwardly to and at their front ends connect to the sliding lock block 180. The rear ends of guide bolts 182, 184 include heads 186, 188. A pair of coil springs 190, 192 are positioned between frame member 174 and lock block 180. Spring 190 surrounds guide bolt 182. Spring 192 surrounds guide bolt 184. A pair of slots 194, 196 are provided in bottom plate 154, forwardly of lock block 180. As shown by FIG. 14, when the front end hook structure is moved upwardly from its down position (FIG. 13) to its up position (FIGS. 14 and 15) the hook tines 170, 172 move upwardly through the slot openings 194, 196. In this up position, the hook tines 170, 172 present hook throats 198, 200 (FIG. 14). The throats 198, 200 are moved into a confronting position with the lock block 180. The side plates are provided with hold down guide members for the lock block 180, one of which is designated 202. An identical hold down guide member is positioned on the opposite side plate 156 in a mirror image position with member 202. Following moment of the front end hook structure up into its up position, shown by FIG. 14, the linear fluid member 178 is extended to move the lock block 180 into the hook throats 198, 200 (FIG. 15). In this position, the lock block 180 locks the front end hook structure into its up position. At the time this is done, the rear coupler pin (not shown) is within the hook throats 162, 164 and the front coupler pin (not shown) is within the front hook throats, one of which (166) is shown in FIG. 13. Thus, when the coupler pins and hook structures are so engaged, and the lock block 180 is moved forwardly into position shown by FIG. 15, the attachment 152 is made secure to the coupler 150 and to the boom or other structure to which the coupler 150 is connected. As clearly shown by FIGS. 13 and 14, when the lock block 180 is retracted, the rear end portions of the bolts 182, 184, including bolt heads 186, 188, extend rearwardly of the frame member 174. When the lock block 180 is moved into its forward position (FIG. 15), the bolt heads 186, 188 are against the frame member 174. This contact of bolt heads 186, 188 with frame member 174 provides a way of limiting the forward movement of the lock block 180.

As in the earlier embodiment, the rounded upper end portions of the hook tines 170, 172 may act to cam the lock block 180 rearwardly as the hook tines 170, 172 move upwardly through the slot openings 194, 196. Then, once the hook tines 170, 172 are in their up position, the springs 190, 192 will force the lock block 180 forwardly into the hook throats 198, 200. Or, the linear fluid motor 178 can be used for extending and retracting the lock block 180. In any event, coupling of the attachment 152 to the coupler 150 can be controlled by the operator sitting in the backhoe or other machine from which the coupler 150 and attachment 152 are supported. In this respect, the embodiment of FIGS. 1–12 and the embodiment of FIGS. 13–15 are alike. The operator can cause coupling and decoupling by operation of the boom structure 12. Movement of the boom structure 12 and the coupler 10, 150 connected to it, together with action of the springs 84 or 190, 192 and/or operation of the fluid motors 114, 122, 178 will cause the coupling of the attachment 94, 152 from the coupler 10, 150. When the springs 84 or 190, 192 are used for biasing the lock members 66 or 116 or 180 forwardly, and the rounded upper ends of the hook tine 60 or 170, 172 are used to cam the lock members 66 or 116 or 180 rearwardly, the coupling can be described as a "snap action" coupling. Following the rearward camming of the block member 66 or 116 or 180, the lock member 66 or 116 or 180 will "snap" forwardly into a locked position, by extension of a spring 84 or 190, 192. The importance of this action is that the operator does not have to leave his station in order to effect a coupling. He does not have to manually insert pins through aligned openings, such as has to be done when using the coupler system disclosed by the aforementioned U.S. Pat. No. 5,584,644. Also, in either case, whether it be by use of the lock arm 66, the lock plate 116 or the lock block 180, there is a strong and secure lock provided by engagement of the lock member 66 or 116 or 180 with the tine hooks 62 or 170, 172.

The illustrated embodiments are only examples of the present invention and, therefore, are non-limitive. It to be understood than many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A coupler connectable to the free end of a boom and to a boom attachment, for connecting the boom attachment to the free end of the boom, by use of a pair of parallel, spaced apart coupler pins on said attachment, said coupler comprising:

a coupler frame including a forward end, a rearward end and a bottom plate, said bottom plate having a forward end slot extending through the bottom plate;

a rear end hook structure connected to the frame below said bottom plate, said rear end hook structure including a rearwardly opening rear hook throat;

a front end hook structure having a front hook throat end and an opposite pivot end, said pivot end being pivotally connected to said frame below said bottom plate, for pivotal movement of the front end hook structure between an up position in which the front hook throat opens forwardly, and a down position in which the front end hook structure and the front hook throat are angled downwardly from said bottom plate;

a top hook on said front hook structure, said top hook extending upwardly from the front end hook structure through the forward end slot in the bottom plate when the front end hook structure is in its up position, said top hook including a top hook tine that is spaced above the bottom plate when the front hook structure is in its up position, to provide a top hook throat between the top hook tine and the bottom plate and further to provide a top cam surface;

a lock member above said bottom plate, movable between a first position in which it is spaced rearwardly from said top hook throat and a second position in which a portion of the lock member is located in said top hook throat, between said top hook tine and the bottom plate, for locking the front hook structure in its up position, wherein said lock member is a swing arm having a first end portion that is pivotally attached to the coupler frame and a second end portion which includes the portion of the lock member that is within the top hook throat when the lock member is in its second position;

a spring positioned to bias the lock member into its second position whereby said boom and coupler can be moved together to position the rear coupler pin of the attachment within the rear hook throat, and further to position the front coupler pin of the attachment within the front hook throat when the front hook structure is in its down position, and then the boom and coupler can be moved relative to the attachment to swing the front hook structure up into its up position and move the top hook into and through the forward end slot, so as to position the top hook tine and top hook throat above the bottom plate, and move the top cam against the lock member, to move the lock member from its second position towards its first position and allow a portion of the lock member to move into the top hook throat, said spring being positioned to then move the lock member back into its second position so that it will block downward movement of the front hook structure from its up position to its down position.

2. A coupler according to claim 1, wherein the rear end hook structure comprises a pair of laterally spaced apart hook members, each including a portion of the rear hook throat.

3. A coupler according to claim 1, wherein the front end hook structure comprises a pair of laterally spaced apart hook members, each including a portion of the front hook throat.

4. A coupler according to claim 3, wherein the rear end hook structure comprises a pair of laterally spaced apart hook members, each including a portion of the rear hook throat.

5. A coupler according to claim 1, comprising lock pin openings in the lock member and in the coupler frame that are alignable when the lock member is in its first position, and a lock pin insertable into the aligned openings for locking the lock member in its first position.

6. A coupler according to claim 1, comprising a gauge rod connected to the lock member and extending rearwardly to the rearward end of the coupler frame, said rear end portion of said gauge member and a rear portion of the coupler frame combining to indicate to an operator positioned behind the boom when the lock member is in its second position.

7. A coupler according to claim 6, wherein the coupler frame includes a wall at its rearward end, and an opening in the wall through which the gauge rod extends, with the position of the rear end of the gauge rod to the rear wall of the coupler frame indicating to a person positioned rearwardly of the boom the position of the lock member.

8. A coupler connectable to the free end of a boom and to a boom attachment, for connecting the boom attachment to the free end of the boom, by use of a pair of parallel, spaced apart front and rear coupler pins on said attachment, said coupler comprising:

a rear end hook structure including a rearwardly opening rear hook throat;

a front end hook structure having a front hook throat end and an opposite pivot end, said pivot end being pivotally connected for pivotal movement of the front end hook structure between an up position in which the front hook throat opens forwardly, and a down position in which the front end hook structure and the front hook throat are angled downwardly;

whereby said boom and coupler can be moved together to position the rear coupler pin of the attachment within the rear hook throat, and further moved to position the front coupler pin of the attachment within the front hook throat when the front hook structure is in its down position, and then the boom and coupler can be moved relative to the attachment to swing the front hook structure up into its up position; and said rear hook throat having both a small coupler pin region and a large coupler pin region and said front hook throat having a small coupler pin region and a large coupler pin region, said small coupler pin regions having arcuate surfaces that engage small coupler pins on an attachment, and said large coupler pin regions having arcuate surface portions that are out of contact with the small coupler pins when the coupler pins are in contact with the throat surfaces of the small coupler pin regions of the hook throats, but make contact with larger coupler pins when used with an attachment having larger coupler pins.

9. A coupler according to claim 8, wherein the rear end hook structure comprises a pair of laterally spaced apart hook members, each including a portion of the rear hook throat.

10. A coupler according to claim 9, wherein the front end hook structure comprises a pair of laterally spaced apart hook members, each including a portion of the front hook throat.

11. A coupler according to claim 8, further comprising a coupler frame including a forward end, a rearward end and a bottom plate, said bottom plate having a forward end slot extending through the bottom plate;

a top hook on said front hook structure, said top hook extending upwardly from the front end hook structure through the forward end slot in the bottom plate when the front end hook structure is in its up position, said top hook including a top hook tine that is spaced above the bottom plate when the front hook structure is in its up position, to provide a top hook throat between the top hook tine and the bottom plate and further to provide the top cam surface;

a lock member above said bottom plate, movable between a first position in which it is spaced rearwardly from said top hook throat and a second position in which a portion ofthe lock member is located in said top hook throat, between said top hook tine and the bottom plate, for locking the front hook structure in its up position;

a spring positioned to bias the lock member into its second position; and whereby said boom and coupler can be moved together to position the rear coupler pin of the attachment within the rear hook throat, and further to position the front coupler pin of the attachment within the front hook throat when the front hook structure is in its down position, and then the boom and coupler can be moved relative to the attachment to swing the front hook structure up into its up position and move the top hook into and through the forward end slot, so as to position the top hook tine and top hook throat above the bottom plate, and move the top cam against the lock member, to move the lock member from its second position towards its first position and allow a portion of the lock member to move into the top hook throat, said spring being positioned to then move the lock member back into its second position so that it will block downward movement of the first hook structure from its up position to its down position.

12. A coupler according to claim 11, wherein the lock member is a swing arm having a first end portion that is pivotally attached to the coupler frame and a second end portion which includes the portion of the lock member that is within the top hook throat when the lock member is in its second position.

13. A coupler according to claim 12, comprising lock pin openings in the lock member and in the coupler frame that are alignable when the lock member is in its first position, and a lock pin insertable into the aligned openings for locking the lock member in its first position.

14. A coupler according to claim 11, comprising lock pin openings in the lock member and in the coupler frame that are alignable when the lock member is in its second position, and a lock pin insertable into the aligned openings for locking the lock member in its second position.

15. A coupler according to claim 11, comprising a gauge rod connected to the lock member and extending rearwardly to the rearward end of the coupler frame, said rear end portion of said gauge member and a rear portion of the coupler frame combining to indicate to an operator positioned behind the boom when the lock member is in its second position.

16. A coupler according to claim 15, wherein the coupler frame includes a wall at its rearward end, and an opening in the wall through which the gauge rod extends, with the position of the rear end of the gauge rod to the rear wall of the coupler frame indicating to a person positioned rearwardly of the boom the position of the lock member.

17. A coupler according to claim 11, wherein the lock member is movable back and forth lengthwise of the coupler frame.

18. A coupler according to claim 17, comprising a spring positioned to bias the lock member into its second position.

19. A coupler connectable to the free end of a boom and to a boom attachment, for connecting the boom attachment to the free end of the boom, by use of a pair of parallel, spaced apart coupler pins on said attachment, said coupler comprising:

a coupler frame including a forward end, a rearward end and a bottom plate, said bottom plate having a pair of laterally spaced apart forward end slots extending through the bottom plate;

a rear end hook structure connected to the frame below said bottom plate, said rear end hook structure including a rearwardly opening rear hook throat;

a front end hook structure having a front hook throat end and an opposite pivot end, said pivot end being pivotally connected to said frame below said bottom plate, for pivotal movement of the front end hook structure between an up position in which the front hook throat opens forwardly, and a down position in which the front end hook structure and the front hook throat are angled downwardly from said bottom plate;

a pair of laterally spaced apart top hooks on said front hook structure, said top hooks extending upwardly from the front end hook structure through the forward end slots in the bottom plate when the front end hook structure is in its up position, said top hooks each including a top hook tine that is spaced above the bottom plate when the front hook structure is in its up position, to provide a top hook throat between the top hook tine and the bottom plate;

an elongated transverse lock member above said bottom plate, movable between a first position in which it is spaced rearwardly from said top hook throats and a second position in which portions of the lock member are located in said top hook throats, between said top hook tine and the bottom plate, for locking the front hook structure in its up position;

a linear motor interconnected between the coupler frame and the lock member and serving to move the lock member between its first and second positions;

a pair of guide rods, one on each side of the linear motor, said guide rods serving to guide the lock member for back and forth movement lengthwise of the coupler frame; and an anchor member on the bottom plate spaced from the forward end slots, and wherein the guide rods extend through the anchor plate and are connected to the lock member, and a compression spring surrounds each guide rod and extends between the lock member and the anchor member, whereby said boom and coupler can be moved together to position the rear coupler pin of the attachment within the rear hook throat, and further to position the front coupler pin of the attachment within the front hook throat when the front hook structure is in its down position, and then the boom and coupler can be moved relative to the attachment to swing the front hook structure up into its up position and move the top hook tines into and through the forward end slots, so as to position the top hook tine and top hook throats above the bottom plate, and whereby the lock member can then be moved from its first position into its second position to place portions of the lock member in the top hook throats, so that the lock member will block downward movement of the front hook structure from its up position to its down position.

* * * * *